US008074993B2

(12) United States Patent
Andersen

(10) Patent No.: US 8,074,993 B2
(45) **Date of Patent: *Dec. 13, 2011**

(54) LIQUID PROJECTILE SHOOTING DEVICE AND GAME

(75) Inventor: Jacob Ranis Stokholm Andersen, Hong Kong (CN)

(73) Assignee: Home Focus Development Ltd., Tortola (GB)

( * ) Notice: Subject to any disclaimer, the term of this patent is extended or adjusted under 35 U.S.C. 154(b) by 0 days.

This patent is subject to a terminal disclaimer.

(21) Appl. No.: 12/067,156

(22) PCT Filed: Sep. 15, 2006

(86) PCT No.: PCT/IB2006/002569

§ 371 (c)(1),
(2), (4) Date: Oct. 3, 2008

(87) PCT Pub. No.: WO2007/031864

PCT Pub. Date: Mar. 22, 2007

(65) Prior Publication Data

US 2009/0127789 A1 May 21, 2009

Related U.S. Application Data

(60) Provisional application No. 60/717,443, filed on Sep. 15, 2009.

(51) Int. Cl.
*A63B 67/00* (2006.01)

(52) U.S. Cl. ..... 273/349; 222/79

(58) Field of Classification Search ..... 273/349, 273/350; 222/79

See application file for complete search history.

(56) References Cited

U.S. PATENT DOCUMENTS

| | | | | |
|---|---|---|---|---|
| 4,135,559 | A * | 1/1979 | Barnby | 141/18 |
| 4,743,030 | A * | 5/1988 | Auer et al. | 273/349 |
| 4,757,946 | A | 7/1988 | Johnson | |
| 5,103,366 | A | 4/1992 | Battochi | |
| 5,295,890 | A | 3/1994 | Myers | |
| 5,373,975 | A | 12/1994 | Husted | |
| 5,411,269 | A | 5/1995 | Thomas | |
| 5,435,569 | A * | 7/1995 | Zilliox | 273/349 |
| 5,549,303 | A * | 8/1996 | Kastner | 273/349 |
| 5,626,343 | A * | 5/1997 | Sanders | 273/349 |
| 5,662,244 | A * | 9/1997 | Liu et al. | 222/79 |
| 5,823,849 | A | 10/1998 | Gardner et al. | |
| 5,826,879 | A | 10/1998 | Spector | |
| 5,865,438 | A * | 2/1999 | Zilliox | 273/349 |
| 5,893,562 | A * | 4/1999 | Spector | 273/349 |
| 6,892,902 | B2 | 5/2005 | Hornsby et al. | |
| 6,929,151 | B1 | 8/2005 | Clayton | |
| 7,179,173 | B2 * | 2/2007 | Henry et al. | 472/128 |
| 7,219,817 | B2 * | 5/2007 | Panzarella | 222/386 |
| 2002/0020712 | A1 | 2/2002 | Hornsby et al. | |
| 2002/0109299 | A1 * | 8/2002 | Rudell et al. | 273/349 |
| 2004/0026864 | A1 | 2/2004 | Kirk et al. | |

(Continued)

FOREIGN PATENT DOCUMENTS

DE 8711369 U1 10/1987

(Continued)

*Primary Examiner* — Mark Graham
(74) *Attorney, Agent, or Firm* — Volpe and Koenig, P.C.

(57) ABSTRACT

A free-standing device for launching a liquid projectile is described. The device comprises a body, a fluid reservoir supported by the body, and a liquid projectile launching mechanism supported by the body and in fluid communication with the fluid reservoir.

8 Claims, 3 Drawing Sheets

U.S. PATENT DOCUMENTS

| | | | | |
|---|---|---|---|---|
| 2004/0164090 | A1 | 8/2004 | Eddins et al. | |
| 2005/0072794 | A1 | 4/2005 | Zimmerman | |
| 2005/0098953 | A1* | 5/2005 | Kirk et al. | 273/349 |
| 2006/0000854 | A1 | 1/2006 | Hornsby et al. | |

FOREIGN PATENT DOCUMENTS

| | | | |
|---|---|---|---|
| EP | 0582759 | A1 | 2/1994 |

* cited by examiner

LIQUID PROJECTILE SHOOTING DEVICE AND GAME

FIELD OF THE INVENTION

The present invention, relates generally to a device, such as a toy, for launching a liquid projectile.

BACKGROUND

Toys which simulate robots, soldiers or the like, and which launch projectiles, provide a constant source of amusement to children. However, solid projectiles launched by such toys (e.g., marbles, plastic missiles or bullets, or the like) can pose a danger to young children who may swallow the projectiles. Also, solid projectiles may cause injury if they strike a person, for example if the projectile is fired at the eye. Solid projectiles can also easily become lost, rendering the toy ineffective. Therefore, what is needed is an improved toy for launching a projectile, where the projectile is safe and is not subject to being lost.

SUMMARY OF THE INVENTION

Liquid projectiles cannot be fired from devices such as toys with sufficient velocity to cause injury, and also cannot cause choking if swallowed. As the liquid projectile is not reused in the same manner as a solid projectile, the liquid projectile cannot become lost.

The invention thus provides a free-standing device, such as a toy, comprising at least one liquid reservoir and at least one liquid projectile launching mechanism. When actuated by the user, the liquid projectile launching mechanism draws a portion of the liquid from the reservoir and launches this portion of liquid outward from the toy.

The invention further provides a game, comprising at least one device of the invention and at least one target or at least two devices of the invention, and optionally rules for game play.

The invention further provides a method of playing a game, comprising the steps of providing a game comprising at least a first device of the invention and a target, and firing liquid projectiles from the device toward the target, such that the target can be struck by the liquid projectiles.

The invention still further provides a method of playing a game, comprising the steps of providing a game comprising at least a first and second device of the invention, and firing liquid projectiles from the first device toward the second device, and from the second device toward the first device, such that the first or second devices are struck by the liquid projectiles. The step of firing liquid projectiles can optionally be repeated until the game is concluded.

The invention yet further provides a method of marketing a device or game of the invention, comprising packaging the device or game with at least one additional item.

BRIEF DESCRIPTION OF THE DRAWINGS

For the purpose of illustrating the invention, there are shown in the drawings forms which are exemplary; it being understood, that this invention is not limited to the precise arrangements and instrumentalities shown.

DETAILED DESCRIPTION

It will be appreciated that the following description is exemplary and is not intended to define or limit the invention, other than in the appended claims. For ease of illustration, the device of the invention is discussed in terms of a toy, although it is understood that the device of the invention can comprise other objects.

As used herein, a "liquid projectile" is a portion of liquid, for example in the form of a drop, projected outwardly from the toy by the liquid projectile shooting mechanism. Once fired from the toy, the liquid projectile is not preferably not enclosed in any container. A liquid projectile also does not necessarily have a fixed or constant volume or mass, and the volume or mass of the liquid projectile may vary from toy to toy or between "shots" fired from the toy. It is understood that the liquid projectile can comprise a portion of the liquid in the liquid reservoir, or can comprise essentially all the liquid in the liquid reservoir of the toy; i.e., all the liquid in the reservoir can be expelled as one "shot." The velocity of the liquid projectile when launched from a device of the invention can vary, but is sufficient to propel the liquid projectile at least some distance from the toy.

Figure 3:
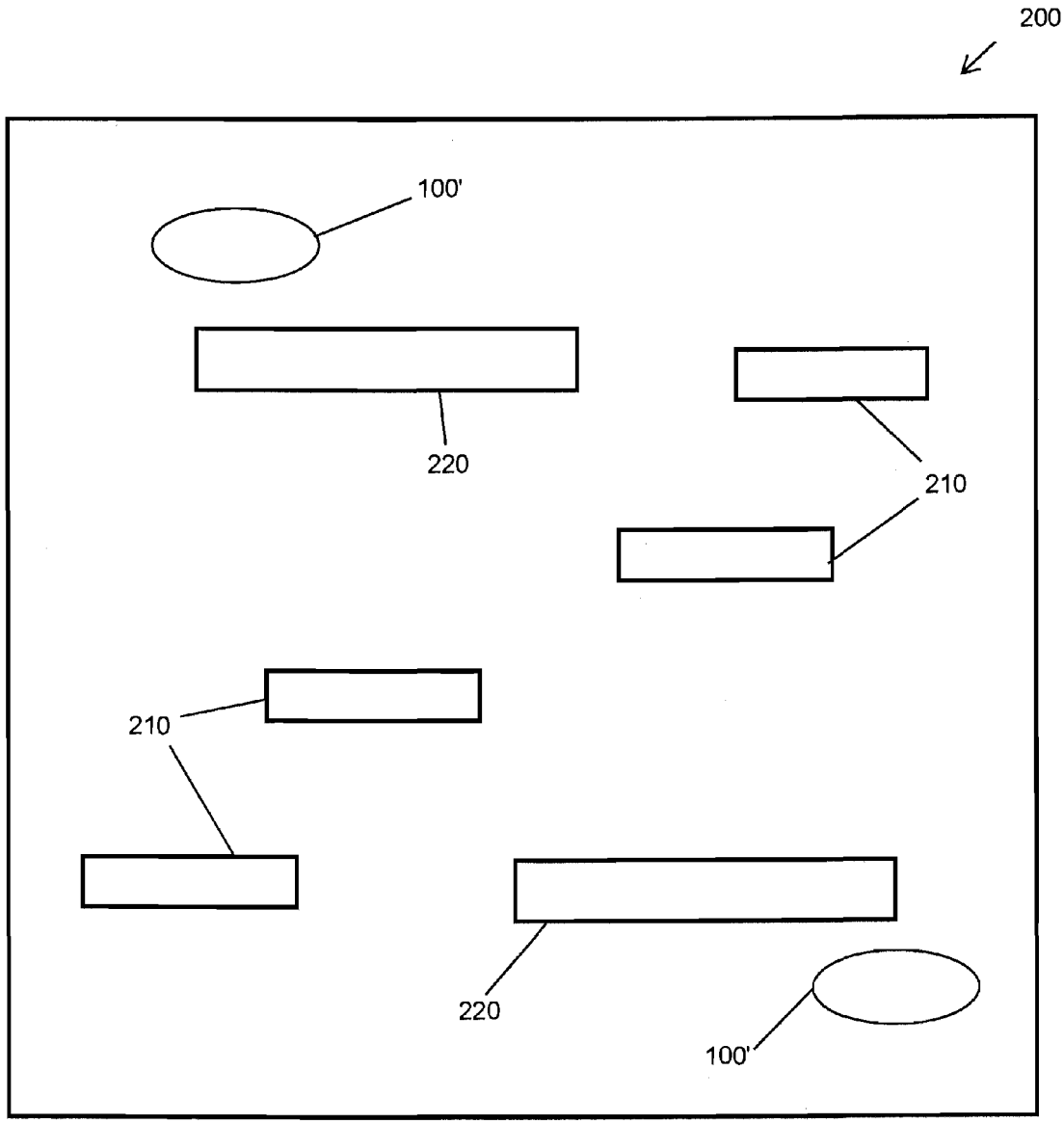
FIG. 3 is schematic representation of a game system, which utilizes the projectile launching device of FIGS. 1 and 2.

A toy 100' (depicted schematically in FIG. 3) of the invention comprises a body which, can support the liquid reservoir and liquid projectile launching mechanism. The body can be made in any suitable size and shape capable of supporting the liquid reservoir and liquid projectile launching mechanism, for example in the shape of a stylized human being or animal, robot, military vehicle or aircraft, spacecraft, or in a fanciful shape. The body can also be made in the likeness (including a caricature) of actual sports or military figures. The body can also comprise limbs or appendages-wheel, and the like which may move independently of me body or other toy components.

The body further comprises one or more structures which allow the toy to be free standing. As used herein, "free standing" means that the toy can stand upright without support from an outside source, such as a user's hand. Thus, the body can comprise a base portion with extensions, flanges, feet, struts, or other supports feat allow the toy to remain upright when unsupported from any source independent of the toy. The toy of the invention can also fire liquid projectiles while free-standing, such as with an electronically activated, automatic liquid projectile launching mechanism.

The body can be essentially flat, (i.e., with minimal thickness), or it can be essentially three dimensional (3-D); i.e., with substantial length and depth. For example, in 3-D form, the toy can have the ability to stand upright Alternatively, an essentially flat body can further comprise feet or other supports extending outward from the flat surface of the body to allow the body to stand upright Thus, both the essentially flat and 3-D bodies can include at least one base member the body to stand upright and to be substantially anchored for the launch of a liquid projectile. The user can hold the toy during launch of the liquid projectile to provide further stability.

The toy can comprise one or more colors, designs or indicia, for example for the purpose of decoration or to indicate different group affiliations. Such colors, designs or indicia can be those associated with actual armies, sports teams or sports or military figures.

The toy can be any suitable size which allows a person to handle the toy and actuate the liquid projectile launching mechanism, as can be readily determined by one skilled in the art. For example, the toy can be from about 5 cm to about 50 cm (e.g., about 10 cm to about 30 cm, about 15 cm to about 25 cm, or about 20 cm) in height, from about 5 cm to about 30 cm (e.g., about 10 cm to about 25 cm, or about 15 cm to about 20 cm) in length (i.e., from left to right sides), and from about 5 cm to about 25 cm (e.g., about 10 cm to about 20 cm, or about 15 cm) in depth (i.e., from front to back). Greater or lesser values are contemplated for the height, length and breadth of the toy.

All or part of the toy can be fabricated from any suitably rigid material, such as heavy gauge paper or cardboard, woods, metals, plastics, rubbers or synthetic resins, as are known in the art, by standard techniques for producing toys or figures. For example, the toy can be fabricated by injection molding or other suitable technique from commercially-available material such as thermo plastic polyurethane (TPU); ionomer resin; ethylene vinyl acetate (EVA); thermo plastic styrenics (TPS); melt processible rubber (MPR); thermo plastic vulcanate (TPV); thermo plastic olefin (TPO); thermo plastic ester elastomer (TPEE); thermo plastic elastomer (TPE); thermoplastic rubber (TPR); polypropylene (PP); polyethylene terphthalate (PET); polyvinyl chloride (PVC); acrylonitrile-butadiene-styrene terpolymer (ABS); a polycarbonate and acryloritrile-butadiene-styrene terpolymer blend (PC/ABS); flexible plastic such as polystyrene sheet or polymethylmethacrylate (PMMA, marketed as "PERSPEX" by ICI Acrylics, Inc.); other acrylics; metal (e.g., stainless steel, aluminum, copper); wood; or any combination thereof. Other suitable materials and forming methods will be apparent to those skilled in the art.

In various embodiments, the toy may be supplied as a fully assembled device or as a kit, wherein a user assembles the toy by popping out prefabricated parts along lines of weakness from a flat piece of plastic, metal or any other suitable material, and then attaches the liquid projectile reservoir and liquid projectile launching mechanism. Generally, the assembly of the toy will not require the aid of tools and/or adhesives, and all the parts can be joined together by the snap-fit of the parts themselves.

The liquid reservoir can comprise any closed or open container suitable for holding liquid. For example, the liquid reservoir can comprise a thin-walled plastic container with a removable cap. In practice, the liquid reservoir can be refilled when the liquid has been depleted during play. Alternatively, the liquid reservoir may not include a removable cap or other means for refilling, and the toy or the liquid reservoir would then be discarded when the liquid in the reservoir is depleted, and the entire toy or the liquid reservoir replaced. (It is envisioned that such a liquid reservoir could be disposable, or provided in a small, inexpensive disposable toy.) The liquid reservoir can be constructed from any suitable material, such as the materials described above for the body, according to techniques within the skill in the art, The liquid reservoir can also be constructed to withstand internal pressure, for example if the air and liquid within the reservoir are pressurized in preparation for firing liquid projectiles, As used herein, "supported by the body" means that the liquid reservoir can be located on the outside of the body, inside the body, or can extend through the body. It is specifically contemplated that the liquid reservoir can be coextensive with the body; for example, the liquid reservoir can be formed by the body, and this configuration is included in the meaning of "supported by the body".

At least one liquid projectile launching mechanism is in fluid communication with one or more liquid reservoirs, for example through a tube or other suitable conduit. A liquid projectile launching mechanism can be located on the outside of the body, inside the body, or can extend through the body. When located outside the body, the liquid projectile launching mechanism can function independently of the body, and can comprise all the elements (including a liquid reservoir) necessary to store and launch a liquid projectile. For example, an independently functioning liquid projectile launching mechanism can represent a gun held in the hand of a toy figure of the invention. Such independently functioning liquid projectile launching mechanisms can be interchangeable from toy to toy. Alternatively, the liquid projectile launching mechanism and the liquid reservoir can be located separately outside the body, and can be removed or interchanged with the liquid projectile launching mechanism or liquid reservoirs on other toys. In any case, that portion of the liquid projectile launching mechanism which discharges and directs the liquid projectile away from the body (called the "discharge tube," see below) should not be obstructed by the body so that the liquid projectile can be launched unimpeded.

The liquid projectile launching mechanism can comprise any suitable mechanism for drawing liquid from the liquid reservoir and launching a portion of liquid outwardly from the toy. For example, the liquid projectile launching mechanism can comprise a simple manual or electric pump mechanism such as are commonly found in plastic squirt guns; see, e.g., U.S. Pat. Nos. 6,892,902 and 5,373,975, the entire disclosures of which is herein incorporated by reference. The pump can force liquid directly through and out the liquid projectile launching mechanism, for example by actuating a piston operably connected to series of valves which allow the liquid to be forcibly ejected from the liquid projectile launching mechanism. Alternatively, the pump can pressurize the liquid reservoir such that the liquid travels through and out the liquid projectile launching mechanism when a valve between the liquid reservoir and liquid projectile launching mechanism is released. The pump can also be configured to draw liquid into the liquid reservoir to replenish the liquid supply therein.

The liquid projectile launching mechanism can also comprise a bladder or other flexible-walled container. The bladder or other flexible-walled container can be filled to overcapacity to create internal pressure, such that liquid can be expelled through an opening in the liquid projectile launching mechanism. The liquid projectile launching mechanism comprising a bladder or other flexible-walled container can also be squeezed to expel the liquid. Where a liquid projectile launching mechanism comprises a bladder or other flexible-walled container, the liquid projectile launching mechanism and the liquid reservoir can be essentially coextensive. For example, the bladder or other flexible-walled container can be the liquid reservoir.

The liquid projectile launching mechanism can also comprise a mechanism which expels hollow or porous projectiles, which are filled or saturated with a liquid. Such mechanisms are known in the art, and can comprise pneumatic systems, spring-loaded systems, or systems in which the projectile is expelled by the potential energy of a rubber band or other elastic material, such as are known in the art. As used herein, a liquid projectile thus includes a hollow or porous projectiles, which are filled or saturated with a liquid. In such configurations, the liquid reservoir may contain liquid, or may comprise a magazine or other similar container for holding the hollow or porous liquid projectiles. It is also contemplated that the toy can comprise further magazines or similar containers for holding the hollow shell or porous material before the liquid has been added. Liquid from a liquid reservoir can then be apportioned into the hollow shells or porous materials to form the liquid projectile before the projectile is fired.

When actuated, the liquid projectile launching mechanism expels liquid projectiles through at least one discharge tube. The discharge tube is considered part of the liquid projectile launching mechanism. The discharge tube can extend away from the body, and may be constructed so that it can be aimed independently of the body; i.e., the discharge tube can be positioned to point or aim in different directions without necessarily changing the orientation of the toy. For example, the discharge tube, or the entire liquid projectile launching mechanism, can be seated on a ball bearing, so that the shooting direction can be changed without moving or changing the orientation of other parts of the toy. The discharge tube can comprise cylinders of differing diameter (see, e.g., FIG. 1) and can comprise other components such as a nozzle.

A discharge tube can be positioned anywhere on the body which allows liquid projectiles to be projected outwardly from the toy when the liquid projectile launching mechanism is actuated. As discussed above, the liquid projectile launching mechanism, can be manually or electronically actuated. If electronically actuated, the liquid projectile launching mechanism can fire multiple liquid projectiles in succession without further input from the user, until the electronic signal is stopped or the liquid reservoir is depleted. Multiple liquid projectiles can also be fired in succession by manual actuation of the liquid projectile launching mechanism. Alternatively, manual or electronic actuation of the liquid projectile launching mechanism can result in the expulsion of essentially all the liquid in the liquid reservoir at once.

Figure 1:
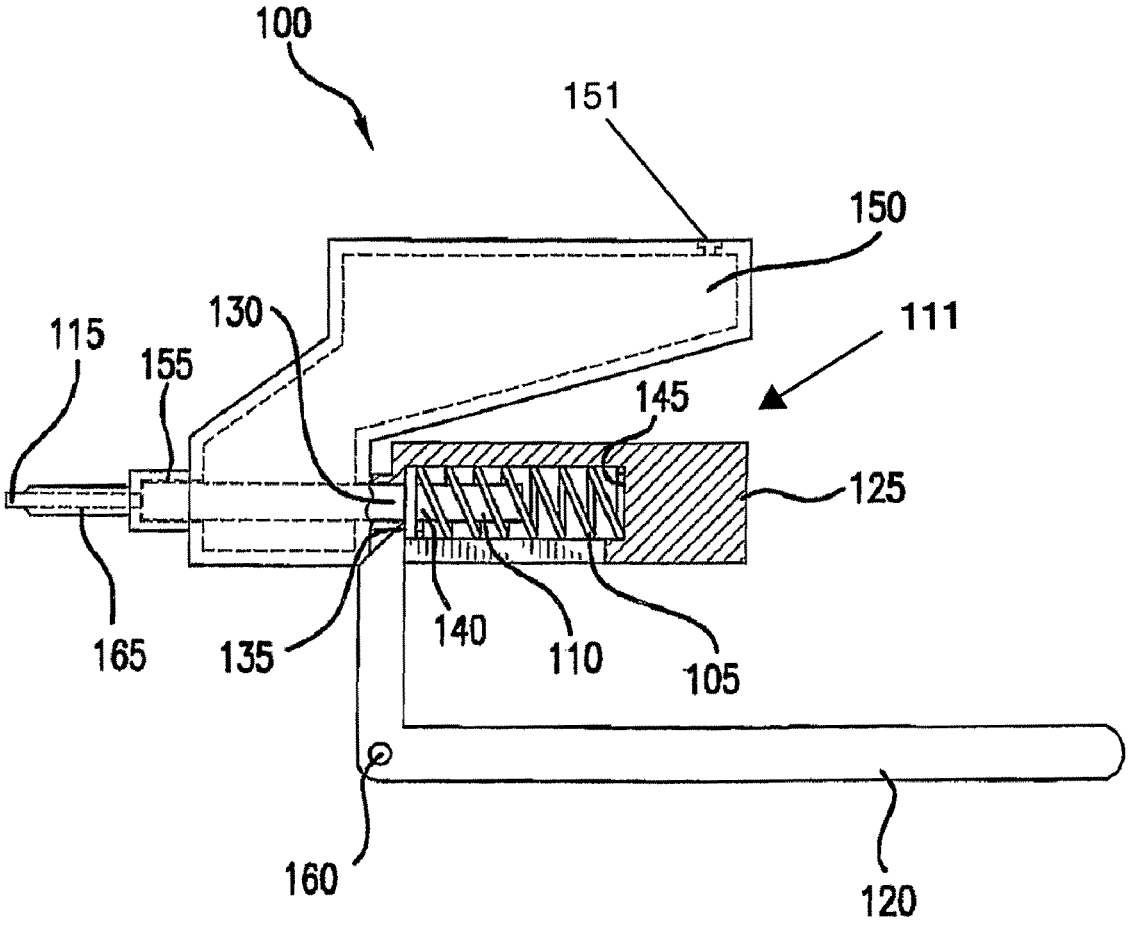
FIG. 1 is an exemplary liquid projectile launching device of the invention.

An exemplary liquid projectile launching mechanism is shown in FIG. 1. With reference to FIG. 1, the exemplary liquid projectile launching mechanism 100 comprises a spring 105 engaged with piston 110 such that the spring 105 forces the piston 110 forward (toward the nozzle 115) when the spring 105 is compressed by action of the trigger 120 as described below. The piston 110 is seated in housing 125, which comprises a channel through with the piston 110 can extend, and together form a pump assembly as indicated by 111. In use, the liquid projectile launching mechanism is actuated by depressing trigger 120 such that the piston is drawn backward (away from nozzle 115) by virtue of the contact between the trigger 120 and piston surface 130 by flange 135, As the piston 110 is drawn, backward, spring 105 is compressed between piston surface 140 and housing surface 145. When the piston 110 is drawn backwards, water from the fluid reservoir 150 will fill the interior of the cylinder 155. Upon reaching essentially file full range of depression, the trigger 120 pivots around a bearing (marked as hole 160), causing the flange 135 to lose contact with piston surface 130 and releasing the piston 110. The piston 110 is then biased forward by the spring 105, and the liquid in the interior of cylinder 155 will travel through the discharge tube 165 and finally out through the nozzle 115 with sufficient velocity to project the liquid away from the nozzle. The reservoir 150 also includes a cap 151 that is removable for refilling the reservoir 150. In an alternative embodiment, the pump 111 can be actuated electronically by an electronic actuator 121 as shown in FIG. 2.

Figure 2:
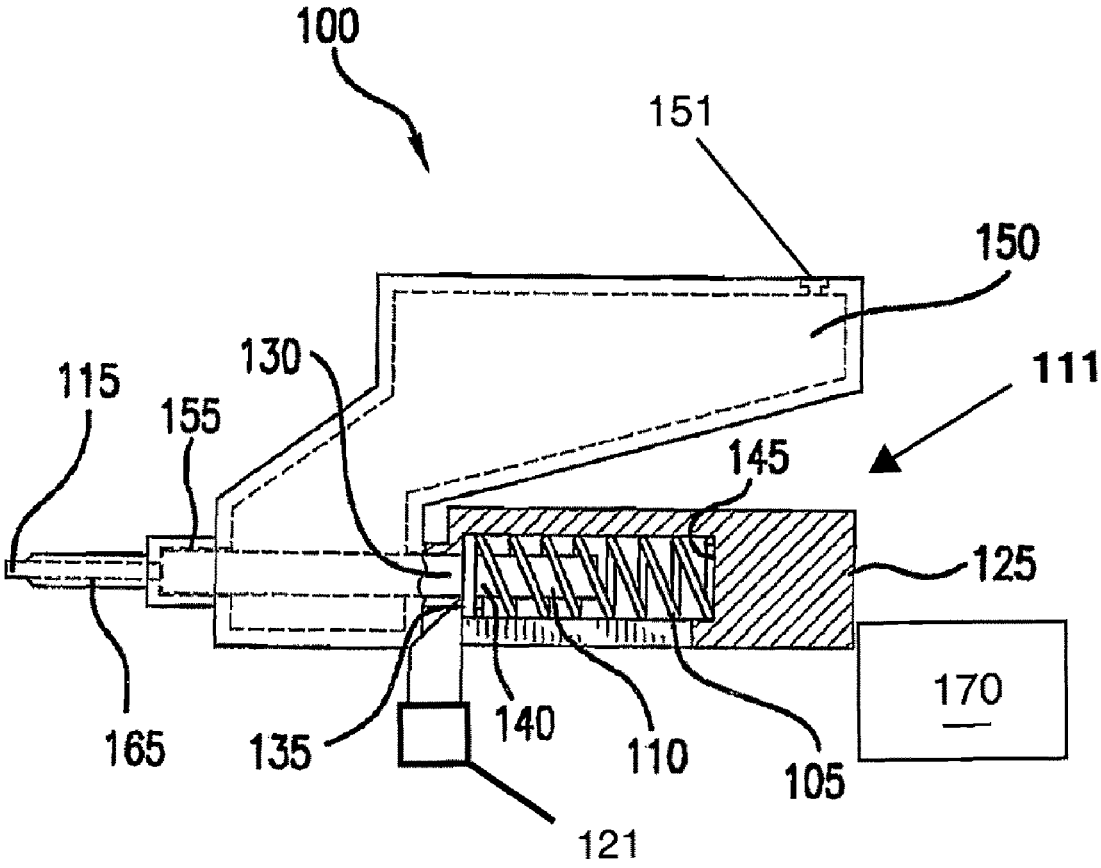
FIG. 2 is an alternate embodiment of the projectile launching device of FIG. 1.

The toy can also comprise electronic components other than, and optionally connected to, any electronic components comprising, shown schematically in FIG. 2 as 170, the liquid projectile launching mechanism. Such electronic components can be activated along with any electronic components comprising the liquid projectile launching mechanism, or can be activated separately. For example, the toy can comprise components for the electronic generation of sound and/or light, or for independent movement of the toy. For example, the toy can comprise limbs or appendages that are connected to drive motors activated by the electronics, Alternatively, the toy can move independently through drive wheel or wheels located on the feet or base of the toy, which are connected to a drive motor activated by the electronics.

Electronics suitable for use in the toy of the invention can include a power source box, or battery box which can be located suitably in the body, for containing batteries or another suitable power source. Suitable wires can be used to couple operable components such as incandescent lights, LED's, switches and speakers. These components can be supported and/or contained in the body, located outside and supported by the body, or can extend through the body. For example, one or more portions of the body can be lighted or adapted to glow by providing a suitable light source such as an LED mounted adjacent to a chamber with transparent or translucent portion.

The electronic components can be activated by actuation of the liquid projectile launching mechanism and/or by the flow of liquid through the liquid projectile launching mechanism. For example, a switch can be mounted adjacent to a conduit or a flexible or soft portion of a conduit, such as conduit carrying pressurized liquid from the liquid reservoir to or through the liquid projectile launching mechanism. The deformation or expansion of the conduit can move one contact element of the switch into contact with the other element, thus activating the electronics.

The electronic components can also be activated by contact with a liquid. For example, the toy can comprise a liquid-responsive switch opening or closing an electric circuit between a battery and a light or sound source when in contact with liquid, A suitable liquid-responsive switch, as is known in the art, comprises a pair of electric terminals impressed with a certain voltage potential. When in the dry state, the impedance between the terminals is very high and the current allowed to circulate is virtually nil. However, when wet, the impedance is dramatically reduced establishing an electrical path which sets a simple transistor circuit in the conduction state, closing the electric circuit between the battery and the light source. Thus, the toy can be activated to emit sound and/or light when struck by a liquid projectile from another source. This arrangement can be used to indicated a "score" or "hit" by another such toy when simulating combat or team sports play with the toys of the invention. A liquid-activated switch can also be operably connected to a liquid projectile launching mechanism, such that the liquid projectile launching mechanism is temporarily inactivated or rendered inoperable when the toy is struck by liquid, for example from another such toy.

The toy 100' can also comprise at least one portion located on the outside of the body which reacts when contacted with a liquid. For example, this portion can comprise a substance which changes color, or loses or gains opacity, when contacted with a liquid. Thus, this portion can act as a target which indicates when it is hit with a liquid projectile. For example, the body can comprise a plastic or cloth that changes color when becoming wet, or can comprise a surface which has been coated with a particulate (e.g., dust, sand, fiberglass, or the like) on the surface, which particulate changes color or becomes transparent when wet, revealing an underlying color. Different portions of the body can comprise at least two liquid reactive materials which react differently from each other when wet. For example, a leg portion of the toy can comprise a material which turns a first color (e.g., green) when wet, and a head portion of the same toy can comprise a material which turns a second color (e.g., blue) when wet. Thus, a game of the invention, depicted schematically in FIG. 3 can comprise at least two toys 100' of the invention which at least one portion comprising a material which reacts when wet. A target 210 included in a game of the invention (see below) can also comprise materials which react differently when wet. For example, the outer areas of the target 210 (which are typically considered lower scoring) can comprise a first material which turns a. first color when wet, and the inner areas of the target, such as the "bulls-eye" or center (typically considered higher-scoring) can comprise a second material which turns a second color when wet. A game of the invention can also comprise a game board 200 or playing arena comprising different obstacles or formations (see below) which comprise materials which react differently when wet For example, a game board 200 or arena can comprise a protective wall 220 behind which a toy 100' of the invention can be hidden while playing a game, which protective wall 220 turns a given color upon being hit by a liquid projectile fired by an opposing toy 100'.

The toy can also comprise at least one portion located on the outside of the body which reacts when contacted with an acidic ox basic solution. For example, this portion can comprise a pH indicator which changes color upon contact with an acid or a base. A suitable pH indicator is one which changes to a certain color (e.g., blue) when contacted with an acidic solution, and changes to another color (e.g., pink or red) when contacted with a basic solution. Thus, a game of the invention can comprise at least two toys of the invention with at least one portion comprising a pH indicator. One toy carries an acidic liquid in its liquid reservoir, and the other toy carries a basic solution. Hits from the toy carrying the acidic solution will cause the other toy to turn a first color, and hits from the toy carrying the basic solution will cause the first toy to turn a second color. The initial color of the pH indicator an a given toy can be restored by removing the acidic or basic solution (such as by washing with water), or by neutralizing with an acidic or basic solution, as appropriate.

With regard to fastening, mounting, attaching or connecting components of the invention to form the toy, unless specifically described otherwise, such are intended to encompass suitable conventional fasteners such as screws, nut and bolt connectors, threaded connectors, snap rings, detent arrangements, clamps such as screw clamps and the like, rivets, toggles, pins and the like. Components can also be connected by adhesives, glues, welding, ultrasonic welding, and friction fitting or deformation, if appropriate, and appropriate liquid and/or airtight seals or sealing devices can be used. Electronic portions of the device can use conventional, commercially available electronic components, connectors and devices such as suitable wiring, connectors, printed circuit boards, microchips, speakers, lights, LED's, liquid crystal displays, pressure sensors, liquid level sensors, audio components, inputs, outputs and the like.

As discussed above, the launch direction of the liquid projectile can be pre-selected by changing the orientation or posture of the toy and/or the discharge tube, to direct the flight path of the liquid projectile, The discharge tube can comprise an open or closed channel through which a conduit can run, or the discharge tube can itself comprise the conduit through which the liquid projectile travels.

The liquid which can be used to form the liquid projectiles of the invention can include any suitable liquid which is compatible with the toy components, and which has a suitably low viscosity such that it can be discharged from the liquid projectile launching mechanism. Suitable liquids include water, such as tap water, spring water, salt water, sugar water or mineral water; inks, such as "disappearing" and other non-permanent inks and permanent inks: dyes, for example washable or other non-permanent dyes and permanent dyes; fluorescent liquids; perfumes; juices; liquid candies and acidic or basic liquids. Generally, acidic or basic liquids for use in the invention comprise a weak acid or base, so as not to damage the toy or toy components and surrounding object, or injure a user.

Toys of the invention can be marketed by packaging the toy with at least one additional item for sale, such as candy or gum, stickers, electronic items, and promotional items such as contests or lotteries and team or league paraphernalia.

Toys 100' of the invention can be utilized to play games in which a user is required to hit an opponent's toy 100', target 210, goal, etc. Thus, the invention provides a game comprising at one toy 100' of the invention and a target 210, or at least two toys 100' of the invention, and suggested rules of play. For example, the game can comprise two teams or armies of toys, with each team or army comprising 1, 2, 3, 4, 5, 10, 20, 50 or more toys 100'.

The target 210 can comprise a liquid-activated switch connected to sound- or light-generating electronics, such as are described above. The target 210 can also comprise at least one portion which reacts when contacted with a liquid, as described above. Thus, the target 210 can indicates when it is hit with a liquid projectile.

A game of the invention, can be played on any generally planar playing surface 200, such, as a floor, table top, desktop, and the like. The playing surface 200 is preferably smooth enough so that the toys can move unimpeded during game play. Alternatively, the playing surface 200 can be uneven or multi-leveled.

A game of the invention optionally comprises one or more game boards 200 which are marked or otherwise carry indicia which simulate, for example, battle fields or fields of play for one or more team sports. It is understood that the markings or indicia which simulate a battle field or field of play on a game board 200 can include rear areas, sideline areas or other areas where individuals not actively participating in the group activity would be located. One skilled in the art is familiar with the relative dimensions and configurations of fields of play for team sports, and can readily adapt such, dimensions and configurations into a game board 200 for use with, the present invention.

In. addition to any markings or indicia which, indicate the field of play, a game board 200 can also comprise regular markings which indicate spaces or distances through, which a toy 100' can be moved in a given turn during game play, or obstacles impeding the movement of toys. For example, a game board 200 can comprise a grid of regular squares or hash marks which dictate the extent to which a toy 100' can be moved during game play. The game board 200 of the invention (e.g., representing a battle field) can comprise mobile or random-appearing obstacle or target. For example, such a game board 200 can comprise flat "pop-up" targets 210 representing opponents, which appear at random intervals and/or locations during game play. Such "pop-up" targets 210 can be controlled by electronics such as are described above, as is known in the art.

The game board 200 of the invention can be fabricated from any suitably smooth and rigid material, such as heavy gauge paper or cardboard, woods, metals, plastics, rubbers or synthetic resins, as are known in the art, by standard techniques. The game board 200 can comprise colors, designs or indicia in addition, to those which mark the field of play, for example which are associated with a particular army, team or league that engages in the group activity being simulated. The game board 200 can also comprise structures which can be attached to or placed on the game board, representing obstacles, geographic features, seats, score boards, goals or goal posts and the like. The game board 200 may be placed on, any flat surface, or may be supported by a frame or by legs, during play.

The game of the invention can also comprise other items, such as a foldable housing to contain the playing pieces and game board (if present) when not in use, scorecards or other devices to record game statistics and results, candy or gum, electronic devices (such as for producing light and sound effects or play-by-play announcements during game play), a timing device, stickers or the like for decorating the game pieces and/or game board, and promotional items such as contests or lotteries and team or league paraphernalia.

The precise rules of play for a game of the invention depend on the type of game desired to be played. For example, the game can comprise rules of play simulating combat. Such rules can be readily designed and understood by one skilled in the art. For example, using the techniques for moving the toys and for shooting liquid projectiles, games simulating various combat situations can be played.

In one such game, two armies of toys can be provided, The individuals playing the game decide beforehand which army shall have initial possession of which parts of the battle field, and which army can attack first For example, the armies can occupy different sections of the battlefield, or one army can occupy the entire battle field, and the second army can attempt to "invade" the occupied territory.

The game is begun by one or more toys of a given army attacking toys of the other army. A toy can attack another toy by launching a liquid projectile toward that toy. The toy which has been attacked will be "wounded" or "killed" if it is struck by the liquid projectile. The "wounded" or "killed" toy is then removed from the board or left in place, and game play continues. "Wounded" toys may be re-introduced to the board or used again after a suitable amount of time has passed, simulating recovery of the wounded soldier.

The game progresses With a series of turns, in which each individual playing the game moves their toys (a "move" includes projecting a weapon at an opposing toy). Multiple toys can be moved in a given turn. The game continues until the expiration of a predetermined time period or until all the toys of one army have been "wounded" or "killed." The army with the most remaining toys at the end of the time period, or the army in possession of a predetermined territory or objective, wins the game.

While the present invention has been described in connection with the examples discussed above and the various figures, it is to be understood that other similar examples may be used, or modifications or additions may be made to the described examples for performing the same function of the present invention without deviating therefrom. Therefore, the present invention should not be limited to any single example, but rather should be construed in breadth and scope in accordance with the recitation of the appended claims.

What is claimed is:

1. A game comprising a board; at least two game pieces, each comprising a device for launching a liquid projectile, the device comprising a body, a fluid reservoir supported by the body, and a liquid projectile launching mechanism supported by the body and in fluid communication with the fluid reservoir, the launching mechanism comprising a piston moveable between a forward position and a rearward position, when the piston is moved in a rearward position, liquid from the fluid reservoir fills an intermediate cylinder, which is in fluid communication between the reservoir and an exit nozzle, a return spring moves the piston forward, closing the reservoir and launching the liquid projectile, wherein the device is free-standing, and the intermediate cylinder is dimensioned such that a metered amount of liquid from the reservoir enters and the liquid projectile is embodied as a single drop; and at least one target, the board comprising a protective wall behind which the game piece can be hidden during game play, the protective wall turning a different color upon being hit by a liquid projectile fired by a game piece.

2. The game of claim 1, further comprising suggested rules of play.

3. The game of claim 1, wherein the target comprises an indicator to show when the target is struck by a drop.

4. The game of claim 3, wherein the indication is a color change, a sound or a light.

5. The game of claim 3, wherein the target comprises an outer area indicator that comprises a first material which turns a first color when wet, and an inner area comprising a second material which turns a second color when wet.

6. The game of claim 1, wherein the board is a floor, a table top or a desktop.

7. The game of claim 1, wherein the board comprises a playing arena including different obstacles or formations.

8. The game of claim 1, wherein the game board comprises materials which react differently when wet.

* * * * *